United States Patent [19]

Sugawara et al.

[11] Patent Number: 4,560,294

[45] Date of Patent: Dec. 24, 1985

[54] PRINTER WITH MULTIPLE TYPE GROUPS

[75] Inventors: Fukuo Sugawara, Yokohama; Yasuhiko Iwane, Morioka, both of Japan

[73] Assignee: Alps Electric Co., Ltd., Japan

[21] Appl. No.: 574,909

[22] Filed: Jan. 30, 1984

[30] Foreign Application Priority Data

Jan. 29, 1983 [JP] Japan ..... 58-12109

[51] Int. Cl.[4] ..... B41J 1/20; B41J 11/00

[52] U.S. Cl. ..... 400/145; 400/146; 400/620; 101/93.14; 101/93.17

[58] Field of Search ..... 400/145, 146, 620; 101/93.14, 93.17

[56] References Cited

U.S. PATENT DOCUMENTS

| | | | |
|---|---|---|---|
| 3,115,092 | 12/1963 | Sasaki | 400/146 X |
| 3,133,497 | 5/1964 | Martin | 400/146 X |
| 3,611,412 | 10/1971 | Gibby | 400/146 X |
| 3,844,395 | 10/1974 | Mero et al. | 400/620 |
| 4,043,440 | 8/1977 | Busch | 400/620 X |
| 4,075,945 | 2/1978 | Bienholz | 400/146 X |
| 4,443,123 | 4/1984 | Ono et al. | 400/146 X |
| 4,455,936 | 6/1984 | Hori | 400/146 X |

*Primary Examiner*—Paul T. Sewell

*Attorney, Agent, or Firm*—Guy W. Shoup

[57] ABSTRACT

A printer comprises paper feed means for feeding a sheet of print paper in a prescribed direction, a plurality of type groups arranged in tiers along the prescribed direction and each having a set of types, a hammer assembly shiftable across the tiers of the type groups for pressing a selected one of the types against the sheet of print paper, means for shifting the hammer assembly across the tiers of the type groups, an arithmetic unit for computing a next amount of feed of the sheet of print paper based on a position of the selected type with reference to a direction across the tiers of the type groups, and paper feed control means for controlling the paper feed means to feed the sheet of print paper and the shifting means to shift the hammer assembly in relation to each other for intervals of time controlled on the basis of the amount of feed of the sheet of print paper as computed by the arithmetic unit.

7 Claims, 56 Drawing Figures

38b
38a
39
25
23
26

PRINTER WITH MULTIPLE TYPE GROUPS

BACKGROUND OF THE INVENTION

The present invention relates to a serial printer, and more particularly to a printer having a plurality of print type groups arranged in tiers spaced along the direction in which a sheet of print paper is fed.

SUMMARY OF THE INVENTION

It is an object of the present invention to provide a printer having multiple type groups which is capable of feeding a sheet of print paper for an accurate interval no matter which type group may be selected for printing.

According to the present invention, a printer comprises paper feed means for feeding a sheet of print paper in a prescribed direction, a plurality of type groups arranged in tiers along the prescribed direction and each having a set of types, a hammer assembly shiftable across the tiers of the type groups for pressing a selected one of the types against the sheet of print paper, means for shifting the hammer assembly across the tiers of the type groups, an arithmetic unit for computing a next amount of feed of the sheet of print paper based on a position of the selected type with reference to a direction across the tiers of the type groups, and paper feed control means for controlling the paper feed means to feed the sheet of print paper and the shifting means to shift the hammer assembly in relation to each other for intervals of time controlled on the basis of the amount of feed of the sheet of print paper as computed by the arithmetic unit. A pair of endless type belts are spaced in the prescribed direction for supporting the respective type groups.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 5(*b*) is a vertical cross-sectional view taken along line b—b of FIG. 5(*a*);

FIG. 5(*c*) is a horizontal cross-sectional view taken along line c—c of FIG. 5(*b*);

FIG. 5(*d*) is a horizontal cross-sectional view taken along line d—d of FIG. 5(*b*);

FIG. 5(*e*) is a horizontal cross-sectional view taken along line e—e of FIG. 5(*b*);

FIG. 5(*f*) is a view showing a cam surface as developed of the shift gear;

FIG. 9(*b*) is a bottom view of the control gear;

FIG. 9(*c*) is a cross-sectional view taken along line c—c of FIG. 9(*a*);

FIG. 9(*d*) is a cross-sectional view taken along line d—d of FIG. 9(*a*);

FIG. 9(*e*) is a cross-sectional view taken along line e—e of FIG. 9(*a*);

FIG. 9(*f*) is a cross-sectional view taken along line f—f of FIG. 9(*a*);

DESCRIPTION OF THE PREFERRED EMBODIMENT

Figure 1:
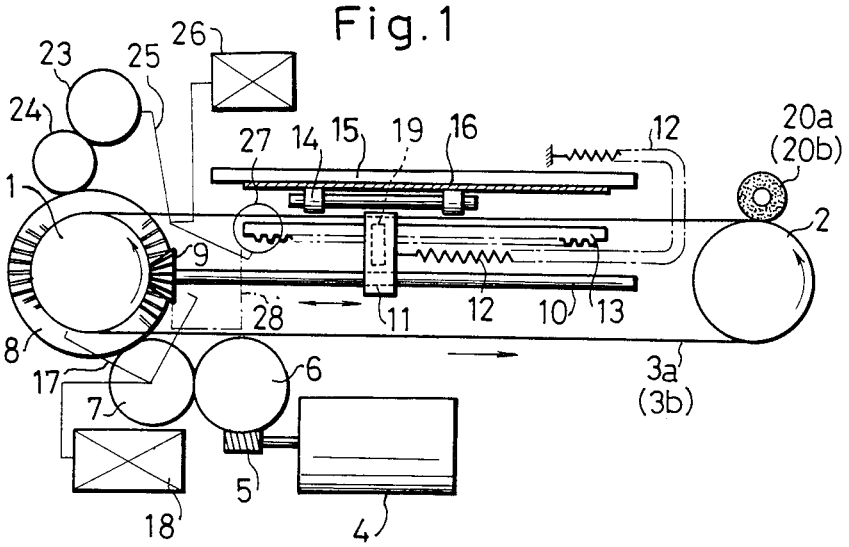
FIG. 1 is a schematic view of a printer according to the present invention.

A printer with multiple type groups according to the present invention will be described in its general entirety with reference to FIG. 1.

Genaral Construction

The printer has a drive pulley 1 and a driven pulley 2 which are spaced a distance from each other, with two endless type belts or chains 3*a*, 3*b* trained therearound in two tiers. A single DC motor 4 serving as a drive source has a rotatable motor shaft supporting a worm 5 attached thereto held in mesh with a first idle gear 6. Drive power from the motor 4 is transmitted through the first idle gear 6, a second idle gear 7 to a main gear 8. Rotative power from the main gear 8 is transmitted via a spring clutch (not shown) to the drive pulley 1. A print and carry gear 9 is kept in mesh with the main gear 8.

To the print and carry gear 9, there is coupled an end of a print and carry shaft 10 on which a hammer holder 11 is axially slidably mounted. The hammer holder 11 houses therein a hammer 19 and carry cam 22. A return spring 12 has one end connected to the hammer holder 11 and the other end fixed to a base (not shown). The hammer holder 11 is normally resiliently urged by the return spring 12 toward a home position close to the driven pulley 2.

A rack 13 is disposed in the vicinity of and parallel to the print and carry shaft 10 and has teeth held in mesh with the carry cam 22. Paper feed rollers 14 and a flat guide plate 15 doubling as a platen are disposed behind the rack 13. A sheet of print paper 16 is fed from below the paper feed roller 14 and the guide plate 15 to a position radially outwardly of the type belts 3*a*, 3*b*. A selector lever 17 serves to shift the rotative power from the main gear 8 from the drive pulley 1 to the print and carry gear 9 at a prescribed timing. The selector lever 17 is controlled for its operation by a first solenoid 18. A pair of upper and lower ink rollers 20*a*, 20*b* is positioned near the driven pulley 2 in confronting relation to the type belts 3*a*, 3*b*, respectively. The ink rollers 20*a*, 20*b* are resiliently pressed against types 21 (FIG. 2) on outer peripheral surfaces of the type belts 3*a*, 3*b* for coating ink on the types 21. The upper and lower ink rollers 20*a*, 20*b* are impregnated with black and red inks, respectively, for enabling two-color printing.

The rotative power from the main gear 8 is also transmitted through a third idle gear 24 to a shift gear 23. When the hammer 19 is not to be shifted, the shift gear 23 is kept out of mesh with the third idle gear 24. The shift gear 23 is controlled for its rotation and stoppage by a pivotable lever 25 that is angularly actuatable by a second solenoid 26.

A control gear 27 is controlled for its rotation in relation to actuation and inactivation of the pivotable lever 25 and a gear clutch lever 28. The control gear 27 includes a paper feed cam 29 (FIG. 2) engageable in mesh with an intermediate gear 30 rotatable in unison with the paper feed rollers 14. The paper feed rollers 14 are rotated via the intermediate gear 30 by the control gear 27 for feeding a sheet of print paper for a given interval.

Figure 3:
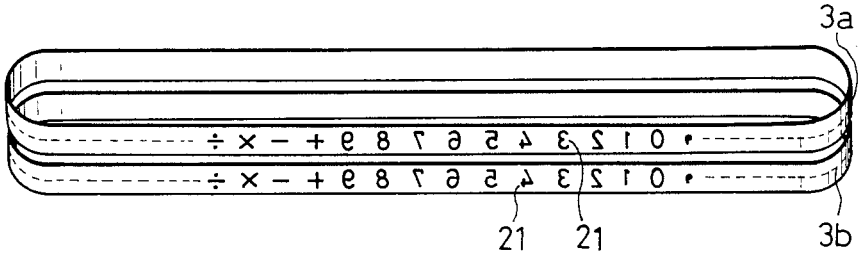
FIG. 3 is a perspective view of type belts employed in the printer.

As shown in FIG. 3, each of the upper and lower type belts 3*a*, 3*b* includes numerical type groups each containing numerical types bearing ten numerals "0" through "9" and symbol type groups each containing symbol types bearing various symbols such as "+", "−", "×", these numerical and symbol type groups being arranged in a predetermined sequence.

Figure 4:
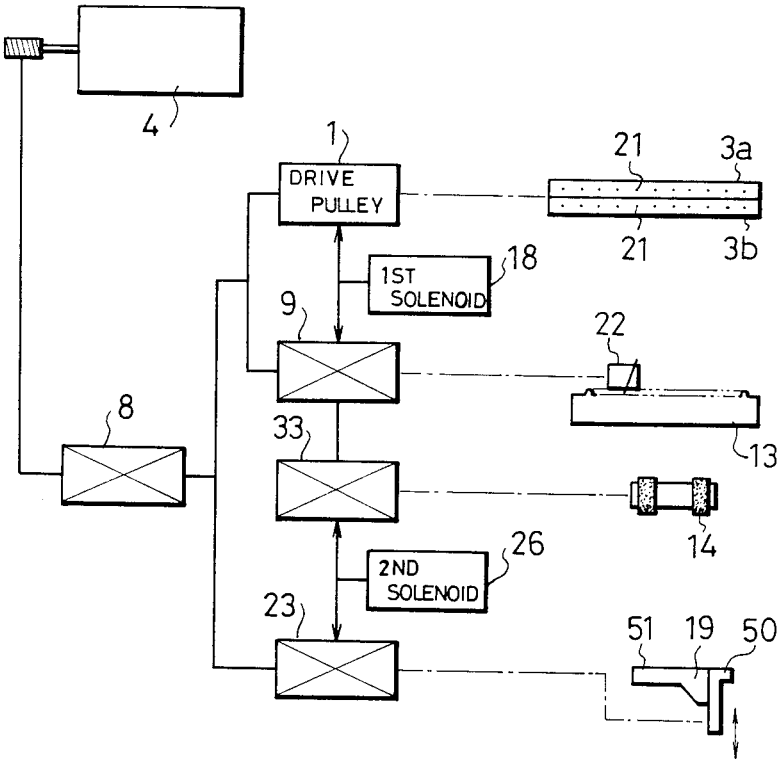
FIG. 4 is a diagram, partly in block form, showing a power transmission system from a DC motor.
Figure 5A:
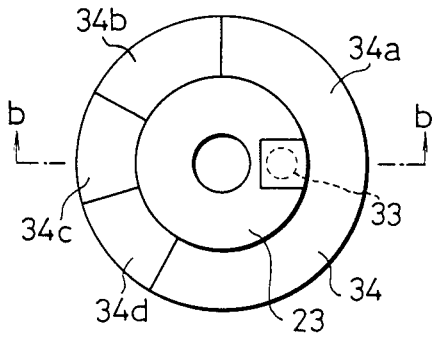
FIG. 5(*a*) is a plan view of a shift gear.
Figure 5C:
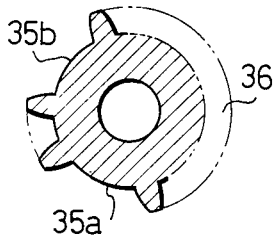
Figure 5D:
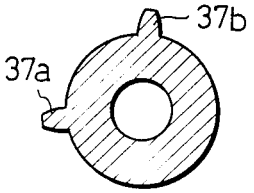
Figure 5B:
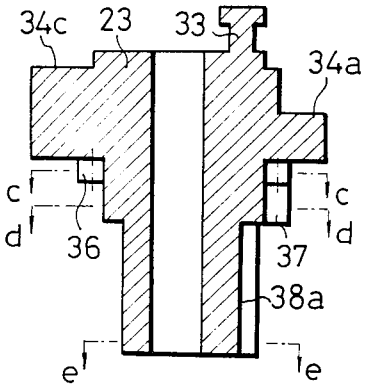
Figure 5E:
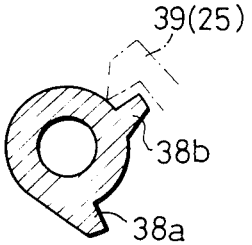
Figure 5F:
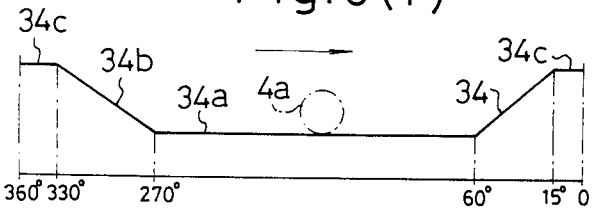

FIG. 4 is a flowchart illustrative of a power transmission system from the DC motor 4. The type belts 3*a*, 3*b* are driven by the drive pulley 1 under the control of the first solenoid 18. The carry cam 22 is rotated by the print and carry gear 9 under the control of the first solenoid 18. The paper feed roller 14 is rotated by the control gear 27 under the control of the first and second solenoids 18, 26. The hammer 19 is shifted by the shift gear 23 under the control of the second solenoid 26.

The basic sequence of operation of the printer includes a type selecting operation, a hammer shifting operation, a print and carry operation, a paper feed operation, and a hammer holder return operation. These operations are sequentially repeated to print desired characters in two colors along a multiplicity of lines.

Figure 2:
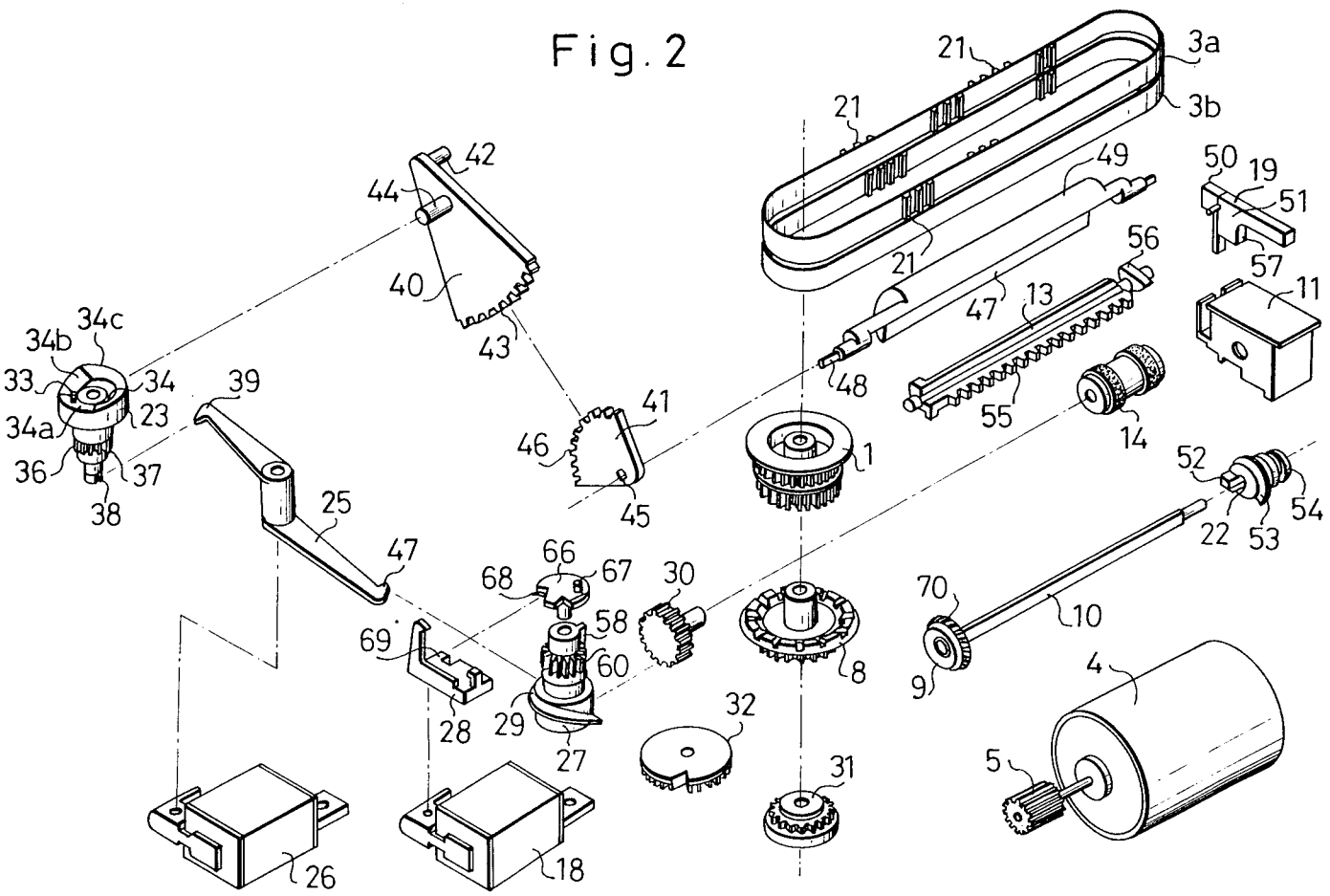
FIG. 2 is an exploded perspective view of the printer shown in FIG. 1.

As shown in FIG. 2, a type selector mechanism comprises a code disk 31 coupled to the main gear 8 for corotation, a sensor gear 32 held in mesh therewith, and a plurality of contacts (not shown) resiliently contacting the code disk 31 and the sensor gear 32. The type selector mechanism first detects a reference position of the type belts 3*a*, 3*b*, and counts pulses corresponding to types subsequent to a pulse indicative of the reference position to select a desired type. The type belt is stopped when the desired type 21 is moved to a position aligned with the hammer 19.

Hammer Shift Mechanism

A mechanism for shifting the hammer 19 will be described. As shown in FIG. 1, the shift gear 23 is ready for being driven by the main gear 8 through the third idle gear 24.

FIGS. 5(*a*) through 5(*f*) illustrate the shift gear 23. As shown in FIGS. 5(*a*) and 5(*b*), the shift gear 23 has on its upper surface a spring engagement projection 33 with which a tension spring engages to urge the shift gear 23 resiliently in one direction. The upper surface of the shift gear 23 has a cam surface 34 including an upper-position flat cam surface 34*a*, a downwardly slanting cam surface 34*b*, a lower-position flat cam surface 34*c*, and an upwardly slanting cam surface 34*d*, these cam surfaces being contiguous in a circumferential direction.

As illustrated in FIG. 5(*c*), a spur gear section 36 is disposed below the cam surface 34 and includes a first tooth-free portion 35*a* and a second tooth-free portion 35*b* angularly spaced from each other. A single-tooth section 37 includes a first single tooth 37*a* and a second single tooth 37*b* formed in angularly spaced relation from each other downwardly of the spur gear section 36, as shown in FIG. 5(*d*). Two locking projections 38*a*, 38*b* are located below the single-tooth section 37 and angularly spaced from each other as illustrated in FIG. 5(*e*). The locking projections 38*a*, 38*b* are engageable with a lefthand pawl 39 of the pivotable lever 25.

Rotation of the shift gear 23 causes a first shift cam gear 40 and a second shift cam gear 41 (see FIG. 2) to turn through a prescribed angular interval. The first shift cam gear 40 is sectorial in shape, and has a pivot shaft 42 projecting from one end, teeth 43 defined on an arcuate edge, and a pin 44 positioned intermediate between the pivot shaft 42 and the teeth 43 and projecting laterally toward the shift gear 23. The pin 44 is held in sliding contact with the cam surfaces 34*a* through 34*d* of the shift gear 23. The second shift cam gear 41 is also sectorial in configuration, and has an elliptical aperture 45 defined in one end and teeth 46 defined on an arcuate edge and held in mesh with the teeth 43 of the first shift cam gear 40. A shift cam 47 has a coaxial end 48 forcibly fitted in the aperture 45 so that the second shift cam gear 41 and the shift cam 47 are rotatable with each other. The shift cam 47 has a longitudinal shift cam surface 49 of a substantially semicircular cross section, the shift cam surface 49 being of a length substantially the same as that of one line to be printed or slightly longer than that.

Figure 6:
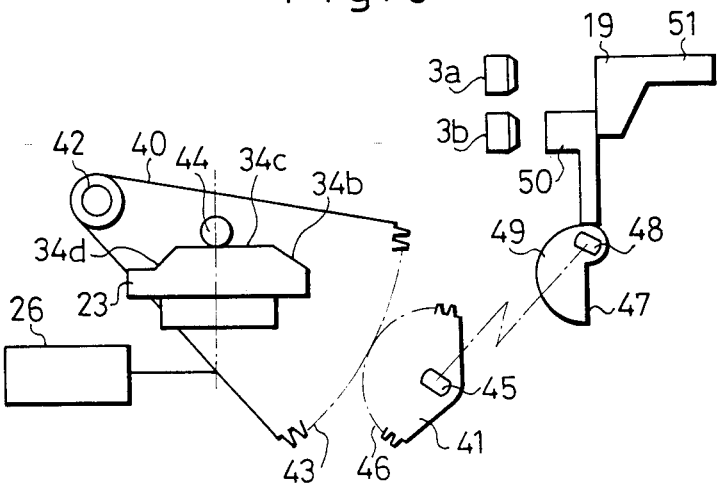
FIGS. 6 and 7 are views illustrative of tha manner in which a hammer is shifted.
Figure 7:
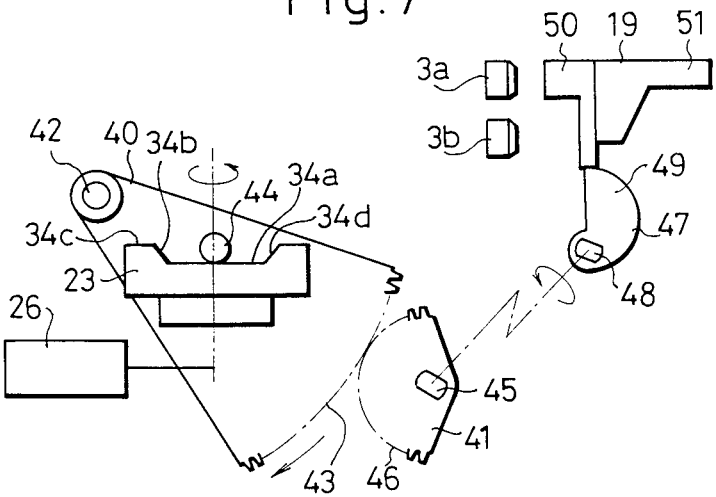

As shown in FIGS. 6 and 7, the hammer 19 has a belt presser 50 with its lower end held in abutment against the peripheral cam surface of the shift cam 49. Although not shown, the belt presser 50 is normally urged resiliently downwardly under the force of a return spring. Therefore, the lower end of the belt presser 50 is kept in resilient contact with the shift cam surface 49 at all times. The hammer 19 is composed of the belt presser 50 and a pusher 51. The pusher 51 has in its front face a vertical dovetail groove (not shown), and the belt presser 50 has a dovetail ridge (not shown) slidably fitted in the dovetail groove. With the dovetail ridge inserted in the dovetail groove, the belt presser 50 is movable back and forth with the pusher 51, and vertically relatively to the pusher 51. The hammer 19 is accommodated in the hammer holder 11, and is normally urged resiliently toward the hammer holder 11 away from the print paper 16 by a tension spring acting between the hammer 19 and the hammer holder 11.

In FIG. 6, the lower type belt 3*b* is selected and the belt presser 50 is positioned in confronting relation to the lower type belt 3*b*. At this time, the lefthand pawl 39 of the pivotable lever 25 engages the first locking projection 38*a*, and the first tooth-free portion 38*a* (FIG. 5(*e*)) faces the third idle gear 24 (FIG. 1). Therefore, the shift gear 23 is stopped, and the belt presser 50 is held in confronting relation to the lower type belt 3*b*.

When the upper type belt 3*a* is to be selected for printing, the hammer 19 is shifted prior to printing. More specifically, the second solenoid 26 is energized by a shift signal issued from a control unit to enable the pivotable lever 25 to turn until the lefthand pawl 39 disengages from the second locking projection 38*b*.

Upon such disengagement, the shift gear 23 is slightly turned under the force of the spring to bring the spur gear 36 between the first and second tooth-free portions 35*a*, 35*b* to mesh with the third idle gear 24. Since the third idle gear 24 is being rotated by the main gear 8, the shift gear 23 is rotated in mesh with the third idle gear 24.

The first shift gear 40 is pulled downwardly by the tension spring with the pin 44 resiliently held in contact with the cam surface 34 of the shift gear 23. As the shift gear 23 rotates, the pin 44 slides up the upwardly slanted cam surface 34*d* onto the upper-position flat cam surface 34*a*. When the pin 44 is thus shifted from the lower-position flat cam surface 34*c* to the upper-position flat cam surface 34*a*, the first shift cam gear 40 is turned clockwise about the pivot shaft 42 through an angular interval corresponding to the vertical distance between the lower-position flat cam surface 34*c* and the upper-position flat cam surface 34*a*. This angular movement of the first shift cam gear 40 causes the second shift cam gear 41 to turn counterclockwise with the shift cam 47, whereupon the belt presser 40 is pushed up into confronting relation to the upper type belt 3*a* as shown in FIG. 7. With the belt presser 50 thus confronting the upper type belt 3*a*, the lefthand pawl 39 of the pivotable lever 25 engages the first locking projection 38*a*, and at the same time the second tooth-free portion 35*b* (FIG. 5(*c*)) faces the third idle gear 24 to stop the rotation of the shift gear 23.

Thus, the hammer shift mechanism rotates the shift gear 23 in response to energization of the second solenoid 26 to cause the first shift cam gear 40, the second shift cam gear 41 and the shift cam 47 to shift the belt presser 50 upwardly or downwardly.

Print and Carry Mechanism

Print and carry operation will then be described. The hammer 19 and the carry cam 22 are housed in the hammer holder 11, with the carry cam 22 being splined to the print and carry shaft 10.

As shown in FIG. 2, the carry cam 22 is composed of a hammer driver 52 extending in one direction from the center to an outer periphery, a carry ridge 53 formed along an outer peripheral surface, and an elliptical rack turning portion 54 for returning the rack. The carry ridge 53 includes a circumferential ridge portion formed along substantially half of the periphery, and a helical ridge portion formed along the remaining half of the periphery, these two ridge portions being contiguous to each other. The carry ridge 53 is held in mesh with teeth 55 of the rack 13. The rack turning portion 54 is kept in abutment against a return lever 56 mounted on an end of the rack 13.

The rack 13 is disposed in the vicinity of and parallel to the print and carry shaft 10 for angular movement through a predetermined angle. Upon angular movement of the rack 13, the rack teeth 55 are brought into or out of mesh with the carry ridge 53 of the carry cam 22.

Figure 8:
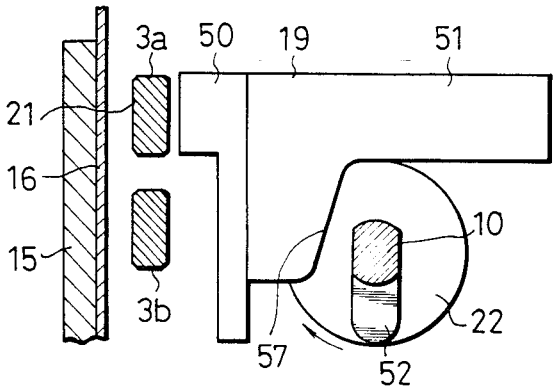
FIGS. 8(*a*) and 8(*b*) are views showing printing operation.
Figure 8:
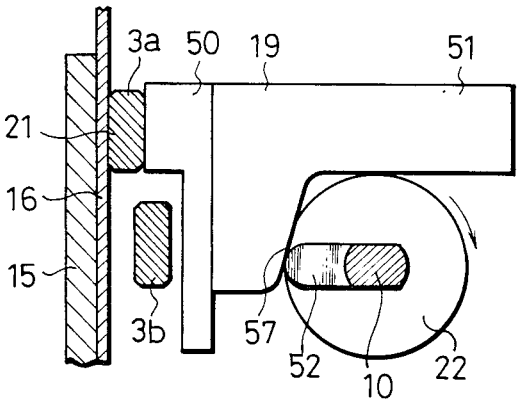
Figure 9A:
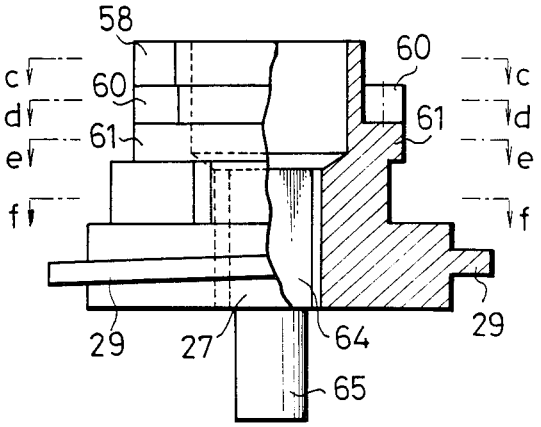
FIG. 9(*a*) is a front elevational view, partly cut away, of a control gear.
Figure 9B:
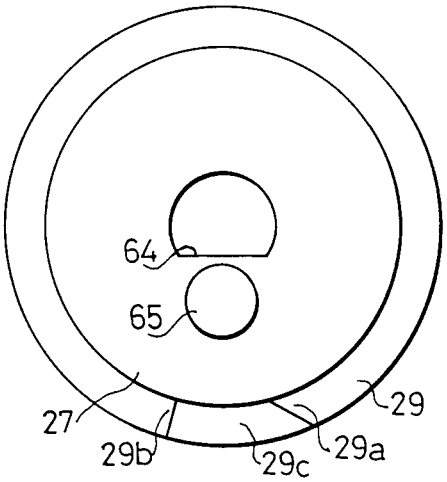
Figure 9C:
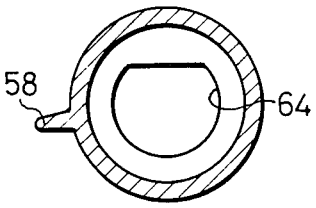
Figure 9D:
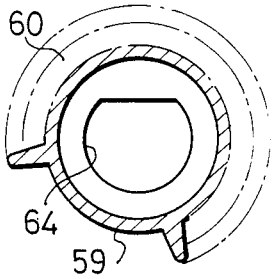
Figure 9E:
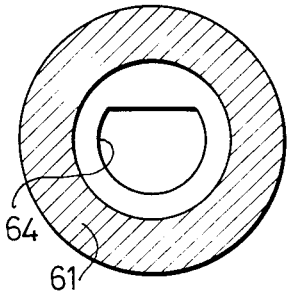
Figure 9F:
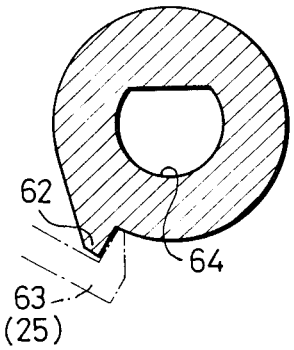

FIGS. 8(*a*) and 8(*b*) illustrate the positions of the parts respectively prior to and during printing operation. Prior to printing operation, as shown in FIG. 8(*a*), the hammer 19 is pulled rearwards by the tension spring and positioned by a stop (not shown). Therefore, the type belts 3*a*, 3*b* are positioned between the print paper 16 and the belt presser 50 in slightly spaced relation thereto, and the hammer driver 52 is directed downwardly out of contact with a bearing portion 57 of the hammer 19.

The print and carry shaft 10 is rotated in the direction of the arrow by the main gear 8 to effect the returning of the rack 13 and the printing in a front half of its revolution and then the carry operation in the latter half of the revolution. More specifically, when the print and carry shaft 10 is rotated in the direction of the arrow, the carry cam 22 is also rotated. During an initial stage of its rotation, the rack turning portion 54 kicks up the return lever 56 to move back the rack 13, bringing the rack teeth 55 into mesh with the carry ridge 53. In such an initial stage of rotation, the circumferential ridge of the carry ridge 53 is kept in mesh with the rack teeth 55, and hence the carry cam 22 (together with the hammer holder 11 and the hammer 19) is not shifted and only rotates through half of the revolution. As the carry cam 22 rotates 180°, the hammer driver 52 abuts against the bearing portion 57 of the hammer 19 as shown in FIG. 8. Continued angular movement of the hammer driver 52 causes the hammer 19 to be pushed forward against the resiliency of the tension spring. Any desired type on the selected upper type belt 3*a* which faces the print paper 16 is pressed against the latter by the hammer 19 to effect desired printing. As the carry cam 22 further rotates, the hammer driver 52 moves upwardly to thereby withdraw the hammer 19 rearwards under the force of the tension spring away from the type belt 3*a*.

When the carry cam 22 further rotates, the helical ridge of the carry ridge 53 is brought into mesh with the rack teeth 55. The rotation of the carry cam 22 enables the hammer holder 11, the hammer 19, and the carry cam 22 to be shifted one character position against the resilient force of the hammer return spring 12. The print and carry operations are successively repeated to print characters along one line.

Paper Feed Mechanism

Paper feed operation will now be described. When one-line printing has been completed, it is necessary to move the hammer holder 11 back to the home position, and feed the print paper for printing along a next line. The control gear 27 is illustrated in FIGS. 9(*a*) through (*f*).

The control gear 27 includes an uppermost single-tooth section 58 having a single radial tooth, and a spur gear section 60 disposed below the single-tooth section 58 and having a tooth-free portion 59, the spur gear section 60 being capable of mesh with the sensor gear 32. The control gear 27 also has a cylindrical portion 61 positioned downwardly of the spur gear section 60 and a locking projection 62 projection radially outwardly and disposed below the cylindrical portion 61. The locking projection 62 is capable of mesh with a right-hand pawl 63 of the pivotable lever 25. A helical paper feed cam 29 is formed circumferentially below the locking projection 62 and has a leading end 29*a* and a trailing end 29*b* with a recess 29*c* defined therebetween. The control gear 27 has a central noncircular hole 64, and a spring engagement pin 65 projecting downwardly from the lower surface of the control gear 27 slightly off center. The control gear 27 is normally urged to turn in one direction under the force of a tension spring (not shown) having one end engaging the spring engagement pin 65.

A reset plate 66 is positioned upwardly of the control gear 27 as shown in FIG. 2. The reset plate 66 has a connector shaft 67 depending centrally from the lower surface thereof and having a cross section complementary in shape to the hole 64 in the control gear 27. With the connector shaft 67 forcibly fitted in the hole 64, the reset plate 66 is rotatable in unison with the control gear 27. The reset plate 66 also has on its upper surface a projection 67 positioned near an outer peripheral edge, and a locking notch 68 for receiving therein a locking end 69 of a gear clutch lever 28.

Figure 10A:
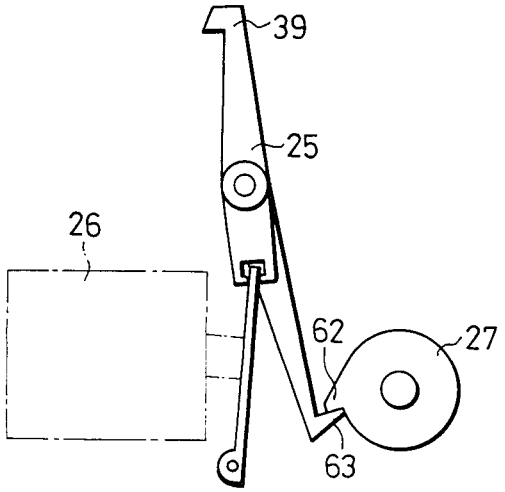
FIGS. 10(*a*) and 10(*b*) are views illustrative of the way in which a sheet of print paper is fed.
Figure 10B:
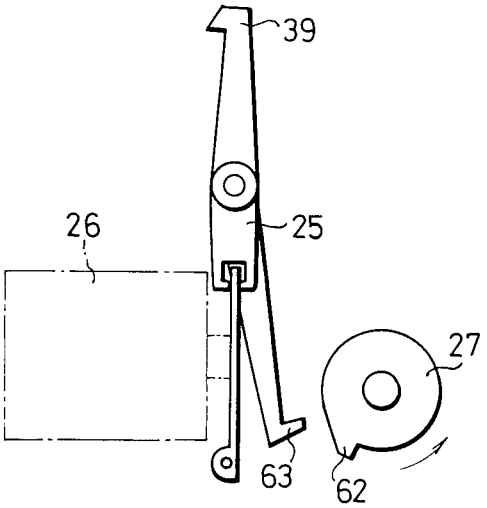

FIGS. 10(*a*) and 10(*b*) show the parts postions respectively prior to and during paper feeding operation. Before the print paper is fed along, the second solenoid 26 remains de-energized, and hence the pivotable lever 25 is urged to turn in one direction by the return spring with its righthand pawl 63 engaging the locking projection 62 of the control gear 27. The control gear 27 is thus stopped against rotation. The tooth-free portion 59 shown in FIG. 9(*d*) is positioned in confronting relation to the teeth of the sensor gear 32. No rotative power from the sensor gear 32 is transmitted to the control gear 27, with the result that the control gear 27, the intermediate gear 30, and the paper feed roller 14 are kept stopped and no print paper is fed along.

To feed the print paper, the second solenoid 26 is required to be energized. Prior to energization of the second solenoid 26, the gear clutch lever 28 has been moved on rotation of the print and carry shaft 10, and the locking end 69 thereof has been disengaged from the locking notch 68 of the reset plate 66. The second solenoid 26 is now energized to cause the pivotable lever 25 to turn against the resiliency of the return spring until the righthand pawl 63 is disengaged from the locking projection 62. The control gear 27 is now slightly turned under the force of the return spring, whereupon the control gear 27 is rotated with the spur gear section 60 illustrated in FIG. 9(*d*) in mesh with the sensor gear 32. This rotation brings the paper feed cam 29 into mesh with the teeth of the intermediate gear 30 for thereby rotating the intermediate gear 30 and the paper feed roller 14 in a prescribed direction for paper feeding operation.

Figure 11:
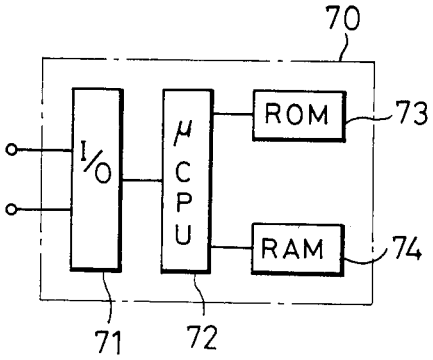
FIG. 11 is a block diagram of a control unit.

FIG. 11 schematically shows a control unit 70. The control unit 70 is contained in the printer and generally comprises an input/output interface 71, a central processing unit 72, a read-only memory (ROM) 73, and a random-access memory (RAM) 74. The ROM 73 stores a control program for controlling various operations of the printer.

Figures 12A, 12B, 12C:
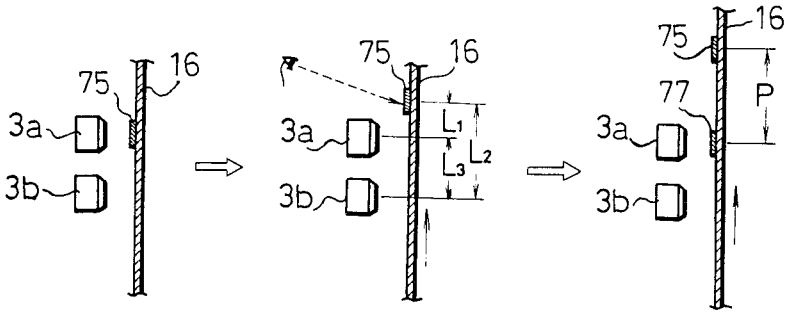
FIGS. 12(*a*), 12(*b*), 12(*c*), 12(*d*) and FIGS. 13(*a*), 13(*b*), 13(*c*), 13(*d*) are views showing interlinear pitch adjustment patterns.
Figure 12D:
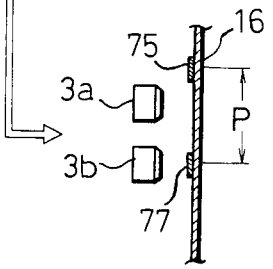

Operation for adjusting an interlinear pitch will be described with reference to FIGS. 12 and 13. For an interlinear pitch adjustment pattern as shown in FIG. 12, the upper type belt 3*a* is first selected as shown in FIG. 12(*a*), and characters are printed in black, for example, in a desired number of positions on the print paper 16. After a line has been printed in this manner, the paper feed rollers 14 are rotated to feed the print paper 16 to move the first printed positions 75 upwardly beyond the upper type belt 3*a* until the printer operator can visually check the printed condition with his eye 76 in a checking position.

Data indicative of which type belt has been selected at first (the upper type belt 3*a* in the illustrated embodiment) is stored into the RAM 74 through the input/output interface 71 under the control of a type belt selection command signal. The ROM 73 stores, in advance, the distance from the upper printing position to the checking position when the upper type belt 3*a* is selected, that is, an amount of feed of paper on selection of the upper type belt, and the distance from the lower printing position to the checking position when the lower type belt 3*b* is selected, that is, an amount of feed of paper on selection of the lower type belt.

Based on the type belt selection signal stored in the RAM 74, the central processing unit 72 reads either the amount of feed of paper on selection of the upper type belt or the amount of feed or paper on selection of the lower type belt out of the ROM 73, and effects an arithmetic operation on the paper feed amount to find an angular interval which the paper feed rollers 14 have to turn. When lower type belt 3*b* is selected for printing, the distance from the lower printing position to the checking position is larger than the corresponding distance at the time the upper type belt 3*a* is selected. Therefore, the paper feed rollers 14 need to be turned for a greater angular interval. Based on the computed angular interval for the paper feed rollers 14, the paper feed rollers 14 are rotated to feed the print paper 16 along. Although not shown, an encoder (not shown) is associated with the paper feed rollers 14 for accurately controlling the angular movement of the paper feed rollers 14, that is, the amount of feed of the print paper 16.

When the next line is to be printed in black as shown in FIG. 12(*c*), the upper type belt 3*a* is selected. Prior thereto, the paper is fed along for interlinear pitch adjustment. More specifically, an interlinear pitch P is predetermined between the first printing postion 75 in which printing has been effected and the second printing position 76 in which printing is to be effected next. A distance L1 from the first printing position 75 now in the checking position to the type belt selected for printing a next character position, that is, the upper type belt 3*a*, is subtracted from the interlinear pitch P by the central processing unit 72 in the control unit 70. Then, the paper feed rollers 14 are rotated for an interval based on the computed difference to feed the print paper 16 upwardly, and thereafter the upper type belt 3*a* is actuated to effect desired printing (FIG. 12(*c*)). This brings the pitch between the first and second printing positions 75, 77 into conformity with the predetermined interlinear pitch P. Then, the paper is fed along to move the printed position 77 to the checking position.

When a next character is to be printed in a different color, red for example, after the first printing postion 75 has been confirmed as shown in FIG. 12(*b*), the lower type belt 3*b* is then selected. A distance L2 from the first printing position 75 now in the checking position to the type belt selected for printing a next character position, that is, the lower type belt 3*b*, is subtracted from the interlinear pitch P by the central processing unit 72 in the control unit 70. In the illustrated embodiment, the checking postion and the position of the lower belt 3*b* are determined so that L2=P, and the subtraction P−L2=0. Therefore, the print paper is not fed along, and a desired character is printed with the lower type belt 3*b* as shown in FIG. 12(*d*). This arrangement shortens the printing time, and the pitch between the first and second printing positions 75, 77 is equalized with the prescribed interlinear pitch P. Then, the print paper is fed along to move the printed position 77 to the checking position.

Figures 13A, 13B, 13C:
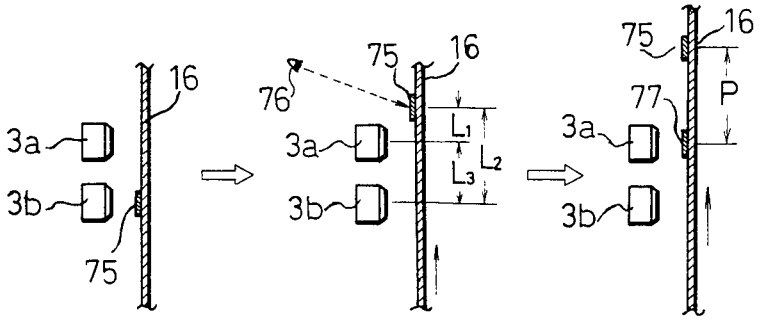
Figure 13D:
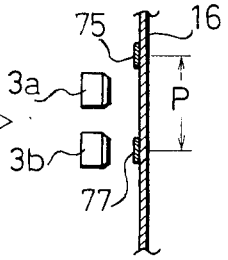

An interlinear pitch adjustment pattern as shown in FIG. 13 will be described. The lower type belt 3*b* is selected at first as shown in FIG. 13(*a*), and a desired number of characters are printed on the print paper 16 with the lower type belt 3*b*. After the line has been printed, the print paper is fed along to shift the first printing position 75 up to the checking position as illustrated in FIG. 13(*b*). Since the amount of feed of the paper on selection of the lower type belt is stored beforehand in the ROM 73, the print paper is automatically fed along after one-line printing has been finished.

Any interlinear pitch adjustment in the case where the upper type belt 3*a* or the lower type belt 3*b* is selected for a next line is effected in the same manner as described with reference to FIG. 12, and will not be described.

Figure 14:
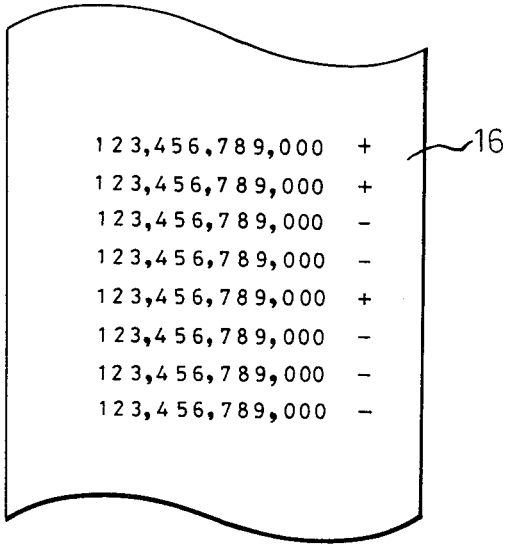
FIG. 14 is a plan view of a sheet of print paper on which characters are printed.

With such interlinear pitch adjustment effected to meet a selected type belt, any printed lines are spaced at equal intervals as shown in FIG. 14 for thereby rendering any printed characters quite sightly in appearance.

Since the type belts 3*a*, 3*b* are arranged in tiers, the print paper should be fed along for different intervals toward the checking position and in interlinear pitch adjustment dependent on the selected type belt 3. Adjustment of an amount of feed of the print paper will then be described.

For paper feed adjustment, the second solenoid 26 is energized selectively for a shorter interval of time (hereinafter referred to as "1WT") and a longer interval of time (hereinafter referred to as "4WT") which is four times longer than the interval 1WT. FIGS. 15 through 18 illustrate the manner in which the shift gear 23 and the pivotable lever 25 interact when the second solenoid 26 is energized for different intervals of time.

Figures 15A, 15B, 15C:
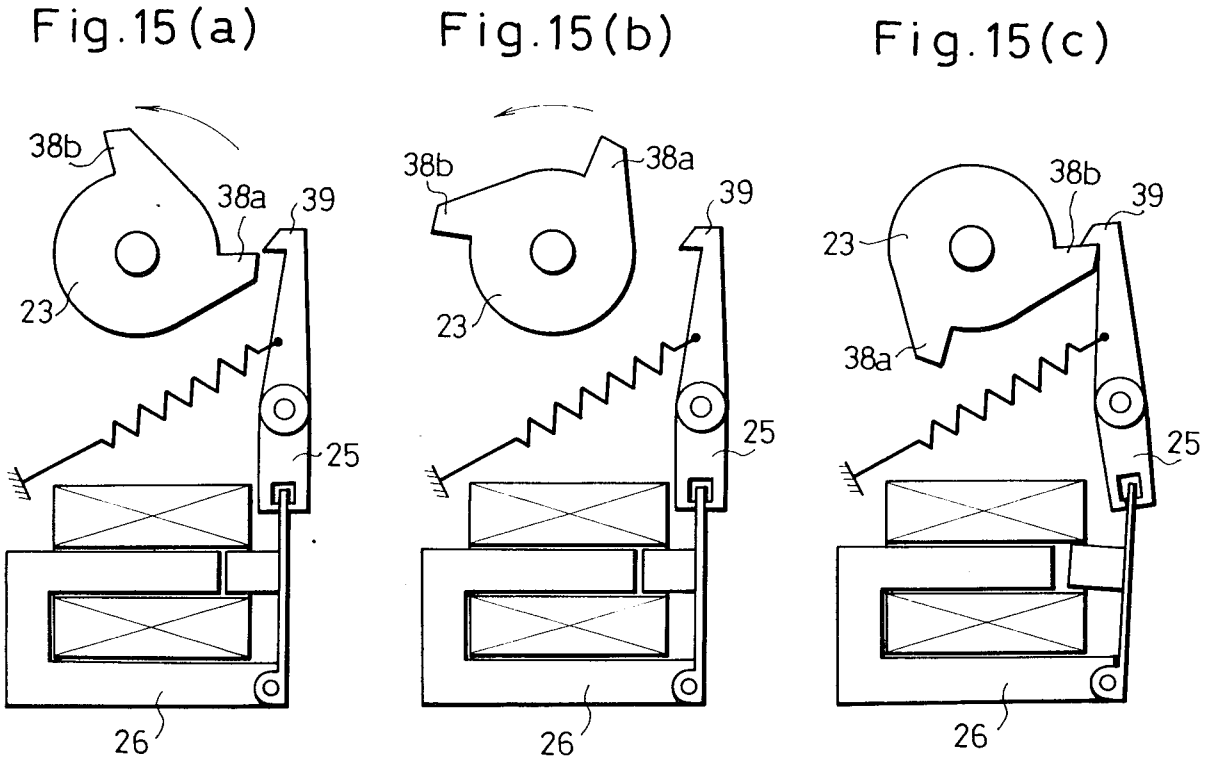
FIGS. 15(*a*), 15(*b*), 15(*c*), 16(*a*), 16(*b*), 16(*c*), 17(*a*), 17(*b*), 17(*c*), and 18(*a*), 18(*b*), 18(*c*) are views showing the shift gear and a pivotable lever as they coact with each other when a second solenoid is energized for different intervals of time.
Figure 19:
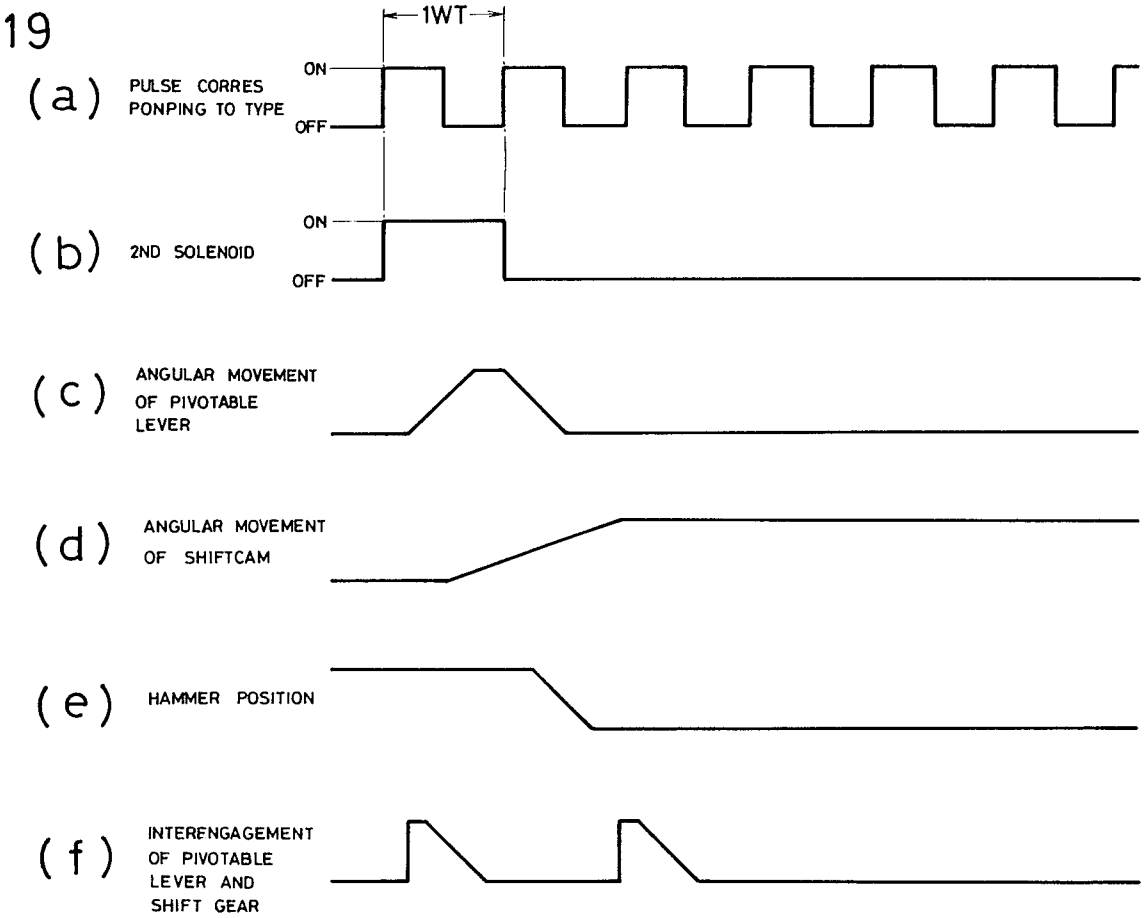
FIGS. 19(*a*)–19(*f*) and 20(*a*)–20(*f*) are timing charts showing the operations of the various parts.

FIGS. 15(*a*), (*b*), (*c*) show the condition in which the solenoid 26 is energized for the interval 1WT, and the pivotable lever 25 disengages from the first locking projection 38*a* and engages the second projection 38*b* of the shift gear 23, that is, the belt presser 50 is shifted from the upper to the lower type belt. FIGS. 19(*a*)–19(*f*) are timing charts showing such operation. FIG. 19 shows pulses (a) generated at predetermined intervals and corresponding respectively to the types, energization and de-energization (b) of the second solenoid 26, angular movement (c) of the pivotable lever 25, angular movement (d) of the shift cam 47, shifted positions (e) of the hammer 19, and engagement (f) of the pivotable lever 25 and the shift gear 23. In this embodiment, the positive-going edge of a pulse is spaced on a time axis from the positive-going edge of a next pulse by the interval 1WT. The operation of the parts will not be described as it has been described previously.

Figure 16A:
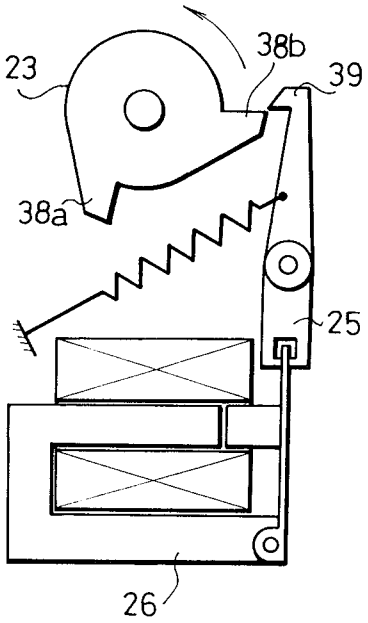
Figure 16B:
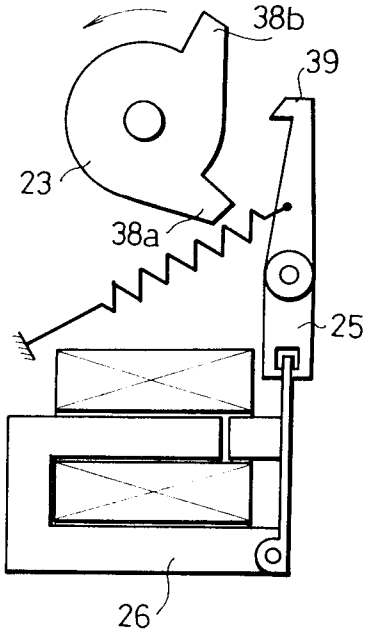
Figure 16C:
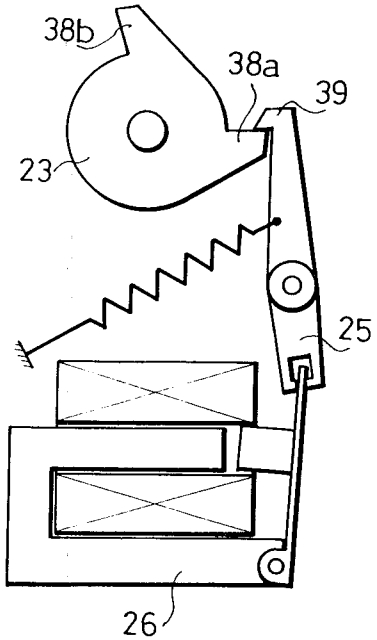

FIGS. 16(*a*), (*b*), (*c*) show the condition in which the solenoid 26 is energized for the interval 1WT, and the pivotable lever 25 disengages from the second locking projection 38*b* and engages the first projection 38*a* of the shift gear 23, that is, the belt presser 50 is shifted from the lower to the upper type belt.

As shown in FIG. 10, the righthand pawl 63 of the pivotable lever 25 is engageable with or disengageable from the locking projection 62 of the control gear 27. Where the second solenoid 26 is energized only for the period 1WT as shown in FIGS. 15 and 16, the control gear 27 makes only one revolution to feed the print paper for a single interval.

Figure 17C:
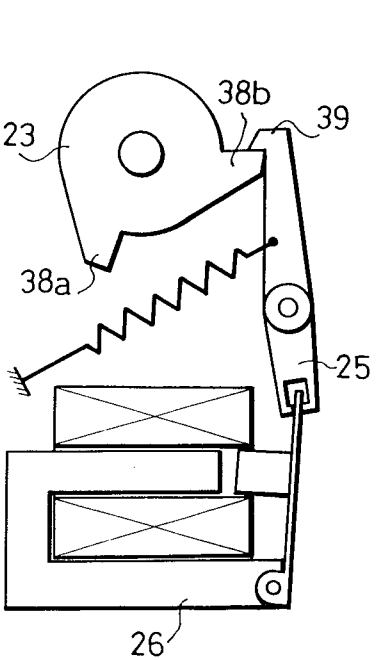
Figure 17B:
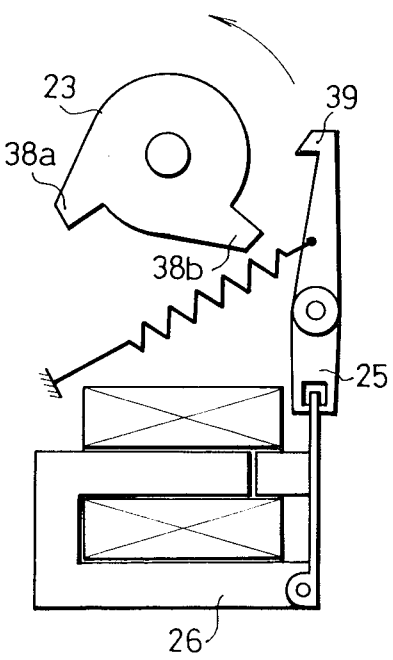
Figure 17A:
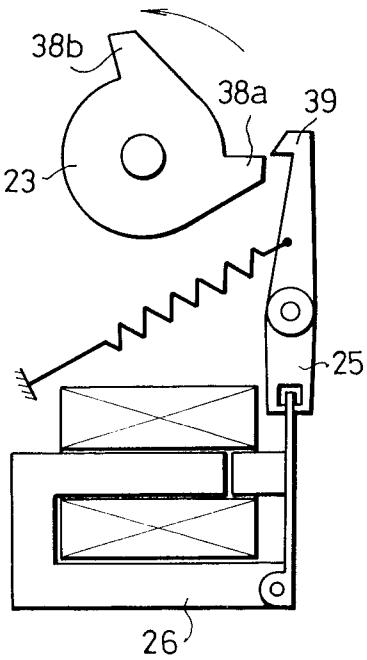

FIGS. 17(*a*), (*b*), (*c*) show the condition in which the solenoid 26 is energized for the interval 4WT, and the pivotable lever 25 disengages from the first locking projection 38*a* and engages the second projection 38*b* of the shift gear 23.

Figure 18A:
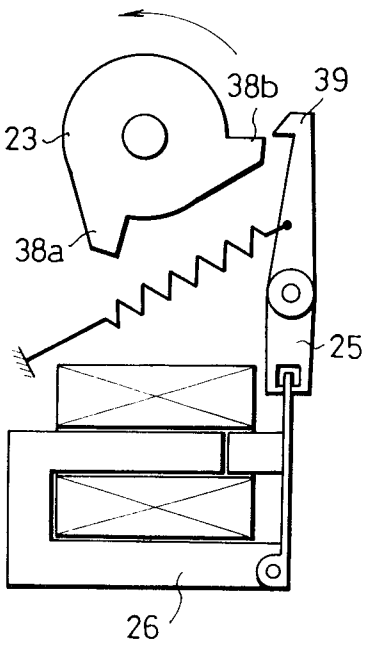
Figure 18B:
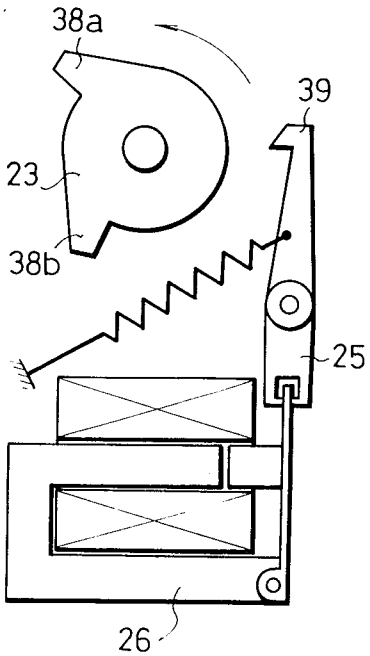
Figure 18C:
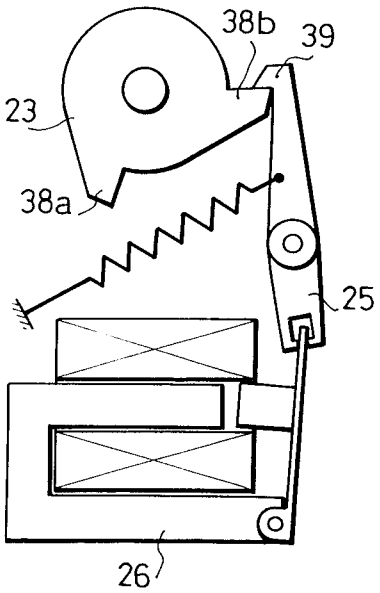
Figure 20:
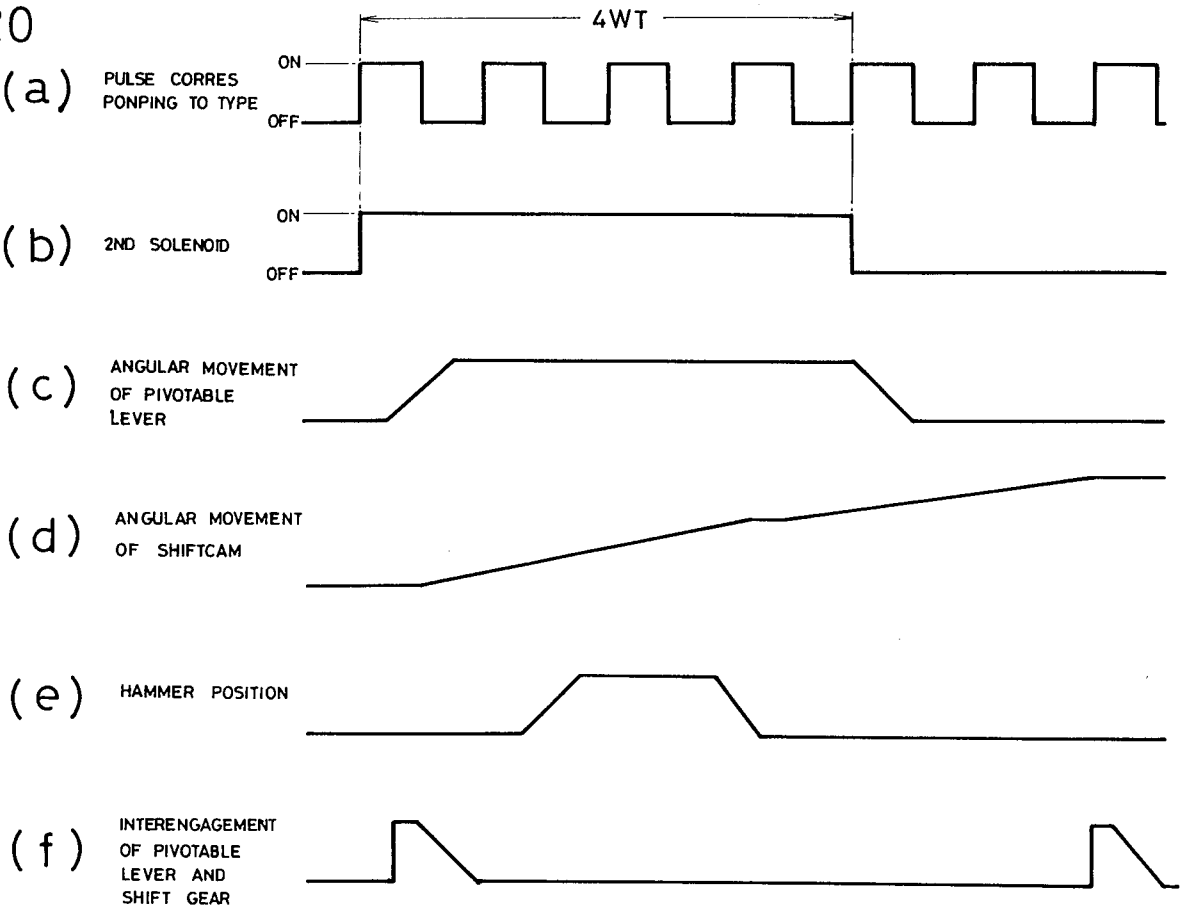

FIGS. 18(*a*), (*b*), (*c*) show the condition in which the solenoid 26 is energized for the interval 4WT, and the pivotable lever 25 disengages from the first locking projection 38*a*, passes across the second locking projection 38*b*, and engages again the second projection 38*b* of the shift gear 23. FIGS. 20(*a*)–20(*f*) are timing charts showing operation of the parts in such an instance. As shown, the positive-going edge of a pulse is spaced on a time axis from the positive-going edge of a fifth pulse by the interval 4WT. FIG. 18 illustrates an operation solely for feeding the print paper along. When the second solenoid 26 is enerigzed for the interval 4WT as shown in FIGS. 17 and 18, the print paper is fed along for two intervals at one time.

Paper feed operation will be described in specific detail with reference to FIGS. 12 and 13. In the illustrated embodiment, with the interlinear pitch between adjacent lines being defined as P, the first printed position 75 in the checking position is spaced from the upper type belt 3*a* by a distance $L1=\frac{1}{3}P$, the first printed position 75 in the checking position is spaced from the lower type belt 3*b* by a distance $L2=1P$, and the upper type belt 3*a* is spaced from the lower type belt 3*b* by a distance $L3=\frac{2}{3}P$. When the second solenoid 26 is energized for the interval 1WT, the paper is fed for a single inerval which corresponds to $\frac{1}{3}P$, and When the second solenoid 26 is energized for the interval 4WT, the paper is fed for two intervals which correspond to $\frac{2}{3}P$, which is twice longer than when the second solenoid 26 is energized for 1WT.

When the upper type belt 3*a* is selected at first for printing as shown in FIG. 12(*a*), the pivotable lever 25 engages the first locking projection 38*a* of the shift gear 23, and the belt presser 50 of the hammer 19 faces the upper type belt 3*a*. After the printing has been effected, the first printed position 75 is shifted to the checking position as shown in FIG. 12(*b*). Since the printing has been carried out with the upper type belt 3*a*, the print paper is to be fed along for the interval corresponding to $\frac{1}{3}P$ before the printed position 75 reaches the checking position. Therefore, the second solenoid 26 is energized for the period 1Wt to feed the print paper for a single interval. After the print paper has been thus fed along, the pivotable lever 25 is held in engagement with the second locking projection 38*b* as shown in FIG. 15(*b*).

When a next line is to be printed with the upper type belt 3*a* again as illustrated in FIG. 12(*c*), the print paper has to be fed along for the interval equivalent to $\frac{2}{3}P$. Although not shown the second solenoid 26 is energized for 4WT to rotate the control gear 27 to make two revolutions for causing the pivotable lever 25 to engage the first locking projection 38*a*. The print paper is then fed along for substantially two intervals corresponding to $\frac{2}{3}P$. The belt presser 50 is positioned into face-to-face relation to the upper type belt 3*a*. Any desired character is then printed with the upper type belt 3*a*.

For printing a next line with the lower type belt 3*b* from the condition of FIG. 12(*b*) as shown in FIG. 12(*d*), no print paper needs to be fed along as the distance L2 between the first printed position 75 in the checking position and the lower type belt 3*b* is equal to the interlinear pitch P. Therefore, the lower type belt 3*b* is employed to effect printing on the print paper as it held at rest.

When the lower type belt 3*b* is used at first for printing as shown in FIG. 13(*a*), the pivotable lever 25 engages the second locking projection 38*b* of the shift gear 23, and the belt presser 50 of the hammer 19 confronts the lower type belt 3*b*. Subsequent to the printing, the first printed position 75 is displaced up to the checking position as shown in FIG. 13(*b*). Since the printing has been effected with the lower type belt 3*b*, the print paper has to be fed along for the interval corresponding to 1P to move the printed position 75 to the checking position. To this end, the second solenoid 26 is energized for 4WT to feed the paper for $\frac{2}{3}$P as shown in FIGS. 18(*a*), (*b*), (*c*), and then for 1WT to feed the paper for $\frac{1}{3}$P as shown in FIGS. 16(*a*), (*b*), (*c*). After the paper has been fed along, the pivotable lever 25 engages the first locking projection 38*a*. The print paper has been fed for substantially three intervals in the foregoing sequence of paper feed operation.

For printing a next line with the upper type belt 3*a* as shown in FIG. 13(*c*), the print paper needs to be fed for the interval equivalent to $\frac{2}{3}$P. To do so, the second solenoid 26 is energized for 4WT to cause the control gear 27 to make two revolutions for bringing the pivotable lever 25 into engagement with the first locking projection 38 again in preparation for the printing of a next line.

When the lower type belt 3*b* is used to print a next line from the position of FIG. 13(*b*) as shown in FIG. 13(*d*), it is unnecessary to feed the print paper. Any desired character can be printed with the lower type belt 3*b* on the print paper held at rest.

With the foregoing arrangement, the print paper can be fed along for an accurate interval no matter which type may be selected. Accordingly, the printer having multiple type groups is reliable in operation.

Although a certain preferred embodiment has been shown and described, it should be understood that many changes and modifications may be made therein without departing from the scope of the appended claims.

What is claimed is:

1. A printer comprising paper feed means for feeding a sheet of print paper in a prescribed direction, a plurality of type groups arranged in tiers along said prescribed direction and each having a set of types, a pair of endless type belts spaced in said prescribed direction and supporting said type groups, respectively, a hammer assembly shiftable across said tiers of said type groups for pressing a selected one of said types against said sheet of print paper, means for shifting said hammer assembly across said tiers of said type groups, an arithmetic unit for computing a next amount of feed of the sheet of print paper based on a position of said selected type with reference to a direction across said tiers of said type groups, and paper feed control means for controlling said paper feed means to feed the sheet of print paper and said shifting means to shift said hammer assembly in relation to each other for intervals of time controlled on the basis of the amount of feed of the sheet of print paper as computed by said arithmetic unit, wherein said arithmetic unit is arranged to feed the sheet of print paper to bring a first printed position printed with one of said pair of endless type belts to a checking position in which a printed condition can be checked, and also to compute an amount of feed of the sheet of print paper to effect printing along a next line in a second printed position printed with one of said pair of endless type belts and spaced from said first printed position by a predetermined interlinear pitch, said first printed position in the checking position being spaced from one of said endless type belts by $\frac{1}{3}$ of said interlinear pitch, and said first printed position in the checking position being spaced from the other of said endless type belts by said interlinear pitch.

2. A printer according to claim 1, wherein said hammer assembly comprises a hammer having a belt presser movable across said tiers in said prescribed direction into confronting relation selectively to said type groups arranged in said tiers.

3. A printer comprising paper feed means for feeding a sheet of print paper in a prescribed direction, a plurality of type groups arranged in tiers along said prescribed direction and each having a set of types, a hammer assembly shiftable across said tiers of said type groups for pressing a selected one of said types against said sheet of print paper, means for shifting said hammer assembly across said tiers of said type groups, an arithmetic unit for computing a next amount of feed of the sheet of print paper based on a position of said selected type with reference to a direction across said tiers of said type groups, and paper feed control means for controlling said paper feed means to feed the sheet of print paper and said shifting means to shift said hammer assembly in relation to each other for intervals of time controlled on the basis of the amount of feed of the sheet of print paper as computed by said arithmetic unit, wherein said shifting means comprises a shift gear having a continuous cam surface including a first-position flat cam surface, a first slanted cam surface, a second-position flat cam surface, and a second slanted cam surface, a shift cam gear angularly movable in response to rotation of said shift gear, and a shift cam angularly movable in response to angular movement of said shift cam gear for shifting said hammer assembly across said tiers of said type groups, and further wherein said paper feed means includes a pivotable lever pivotably movable by a solenoid energizable for longer and shorter intervals of time, said shift gear having first and second locking projections, said pivotalby lever being engageable selectively with said first and second locking projections through combinations of said longer and shorter intervals of time in which said solenoid is energizable for holding said hammer assembly in positions corresponding to said tiers of said type groups.

4. A printer according to claim 3, wherein said pivotable lever has a pawl for engaging a locking projection of a control gear when said pivotable lever is actuated by said solenoid for thereby stopping the feeding of the sheet of print paper.

5. A printer according to claim 4, wherein said one revolution of said shift gear corresponding to seven pulses each corresponding to one type, said first and second locking projections being angularly spaced through an interval corresponding to two of said pulses.

6. A printer according to claim 5, wherein said longer and shorter intervals of time of energization of said solenoid correspond to four and one, respectively, of siad pulses.

7. A printer comprising paper feed means for feeding a sheet of print paper in a prescribed direction, a plurality of type groups arranged in tiers along said prescribed direction and each having a set of types, a pair of endless type belts spaced in said prescribed direction and supporting said type groups, respectively, a hammer assembly shiftable across said tiers of said type groups for pressing a selected one of said types against said sheet of print paper, said hammer assembly comprising a hammer having a belt presser movable across said tiers in said prescribed direction into confronting relation selectively to said type groups, means for shifting said hammer assembly across said tiers of said type groups, an arithmetic unit for computing a next amount of feed of the sheet of print paper based on a position of said selected type with reference to a direction across said tiers of said type groups, and paper feed control means for controlling said paper feed means to feed the sheet of print paper and said shifting means to shift said hammer assembly in relation to each other for intervals of time controlled on the basis of the amount of feed of the sheet of print paper as computed by said arithmetic unit, wherein said arithmetic unit is arranged to feed the sheet of print paper to bring a first printed position printed with one of said pair of endless type belts to a checking position in which a printed condition can be checked, said first printed position in the checking position being spaced from one of said endless type belts by $\frac{1}{3}$ of a predetermined interlinear pitch, and said first printed position in the checking position being spaced from the other of said endless type belts by said interlinear pitch.

* * * * *